US005155770A

United States Patent [19]

Maejima

[11] Patent Number: 5,155,770

[45] Date of Patent: Oct. 13, 1992

[54] SURROUND PROCESSOR FOR AUDIO SIGNAL

[75] Inventor: Yoshimichi Maejima, Kanagawa, Japan

[73] Assignee: Sony Corporation, Tokyo, Japan

[21] Appl. No.: 754,529

[22] Filed: Sep. 4, 1991

[30] Foreign Application Priority Data

Sep. 17, 1990 [JP] Japan ..... 2-243910

[51] Int. Cl.[5] ..... H04H 5/00; H04R 5/00

[52] U.S. Cl. ..... 381/18; 381/11; 381/22

[58] Field of Search ..... 351/22, 18, 11, 1, 2, 351/10, 12

[56] References Cited

U.S. PATENT DOCUMENTS

| | | | |
|---|---|---|---|
| 3,772,479 | 11/1973 | Hilbert . | |
| 3,787,629 | 1/1974 | Limberg | 381/11 |
| 3,934,086 | 1/1976 | Takahashi | 381/22 |
| 4,091,241 | 5/1978 | Sakaida | 381/11 |
| 4,815,133 | 3/1989 | Hibino . | |
| 4,833,715 | 5/1989 | Sakai | 381/11 |
| 4,907,082 | 3/1990 | Richards | 358/143 |

FOREIGN PATENT DOCUMENTS 367569 5/1990 European Pat. Off. .

*Primary Examiner*—James L. Dwyer
*Assistant Examiner*—Jack Chang
*Attorney, Agent, or Firm*—Lewis H. Eslinger; Jay H. Maioli

[57] ABSTRACT

A surround processor adapted to apply a stereo surround processing and a monaural surround processing to audio input signals of two channels to provide surround processed outputs, wherein a stereo/monaural discrimination output based on inputted audio signals of two channels is caused to have a predetermined time constant to provide a mixture ratio control signal to change a mixture ratio between a stereo surround processing output signal and a monaural surround processing output signal, to thereby discriminate whether an input signal is a stereo signal or a monaural signal and to automatically carry out switching between the surround processing output. The time constant prevents switching between the stereo surround processing state and the monaural surround processing state from being suddenly conducted.

3 Claims, 2 Drawing Sheets

SURROUND PROCESSOR FOR AUDIO SIGNAL

FIELD OF THE INVENTION

This invention relates to a surround processor for carrying out surround processing of stereo input signals or a monaural input signal.

PRIOR ART

In recent years, techniques have been frequently adopted to apply surround processing to an audio signal to provide improved presence of sound. For carrying out surround processing, various surround processing systems have been proposed. The surround processing system of this kind is roughly classified into the stereo surround processing system to carry out surround processing of stereo input signals, and the monaural processing system to apply surround processing to a monaural input signal so that it is changed to a pseudo-stereo signal or a signal of further improved presence of sound.

The circuit of the stereo surround processing system normally operates satisfactorily with respect to the stereo audio input signals, but fails to carry out acceptable surround processing with respect to a monaural audio input signal. On the contrary, in the case where stereo audio signals are input to the monaural surround processing (e.g., pseudo-stereo) circuit, there is the possibility that incompatibility may occur. To avoid this, it is required to carry out switching between the stereo surround processing circuit and the monaural surround processing circuit in dependency upon whether the input comprises stereo signals or a monaural signal.

Meanwhile, in the case of a surround processing circuit provided in a sound multiplex broadcast correspondence type television image receiver, an approach is employed to detect a stereo pilot signal of a television broadcast signal, or a similar approach is employed to thereby discriminate whether an input audio signal is a stereo signal or a monaural signal, thus making it possible to carry out a control to automatically conduct a switching between the stereo surround processing mode and the monaural surround processing mode.

However, in typical surround processors, it is difficult to precisely discriminate whether an input signal is a stereo signal or a monaural signal. For example, a discrimination system is conceivable to make a comparison between respective signal levels of the left and right channels of an audio input signal, thus to make a discrimination between stereo and monaural modes in dependency upon the degree of the level difference. However, this discrimination system has the drawback that even if an input signal is a stereo signal, when a sound image is localized at the center, signal levels of the left and right channels become equal to each other, so the stereo signal cannot be discriminated from the monaural signal. For this reason, at present the user manually carries out mode switching between the stereo/monaural signals.

SUMMARY OF THE INVENTION

With the above in view, an object of this invention is to provide a surround processor capable of effectively carrying out switching selection of an optimum surround processing signal without hindrance in practical use in dependency upon whether an input audio signal is a stereo signal or a monaural signal.

To achieve the above-mentioned object, there is provided a surround processor for an audio signal comprising; a pair of input terminals supplied with two channel audio signals, a stereo surround processing circuit, a monaural surround processing circuit, a mixture ratio verifying means for mixing a signal from the stereo surround processing circuit and a signal from the monaural surround processing circuit.

DESCRIPTION OF THE PREFERRED EMBODIMENT

Figure 1:
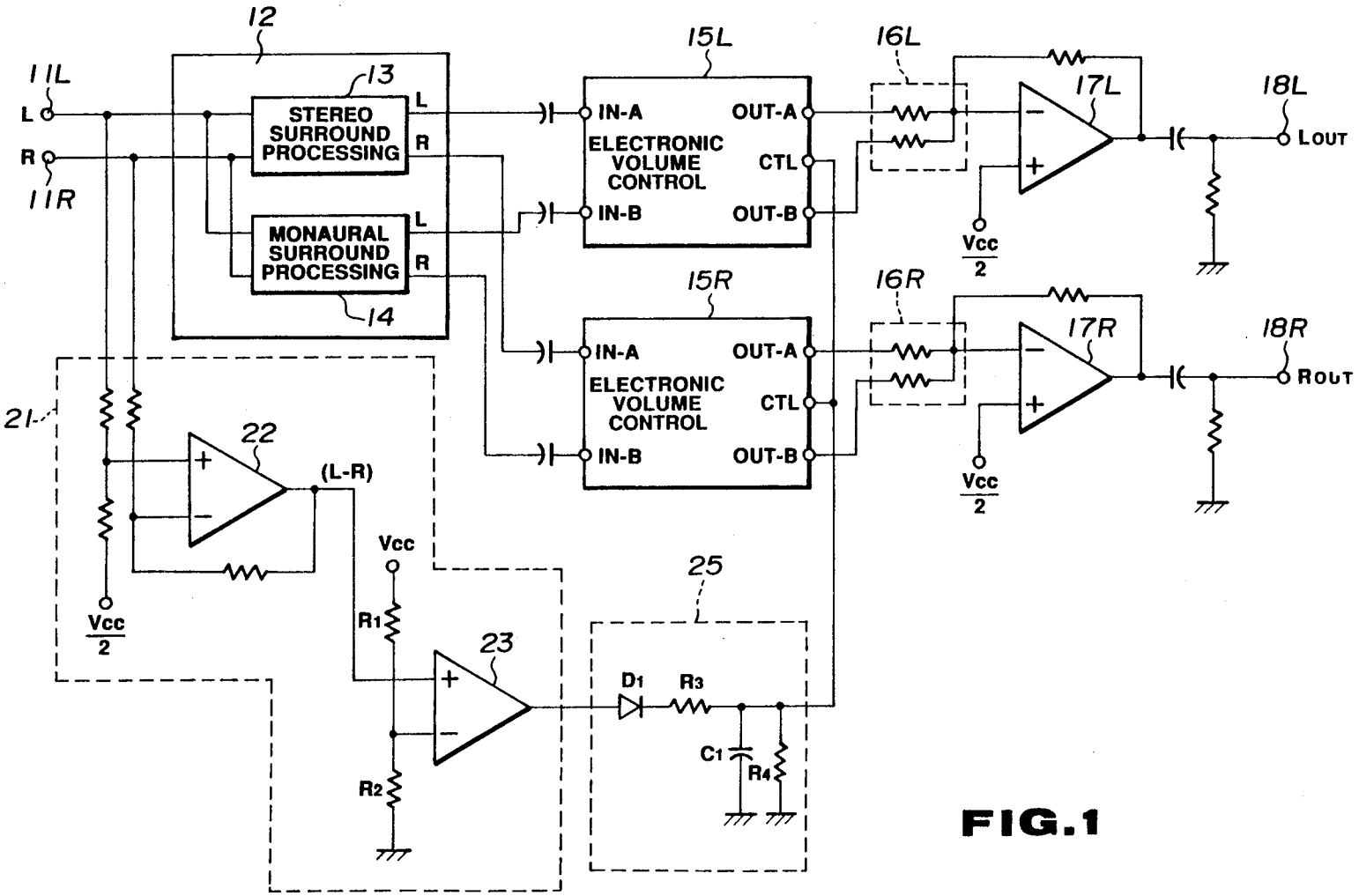
FIG. 1 is a block diagram of an embodiment of a surround processor according to this invention.

FIG. 1 is a circuit diagram showing, in a block form, an embodiment of a surround processor according to this invention.

Figure 2:
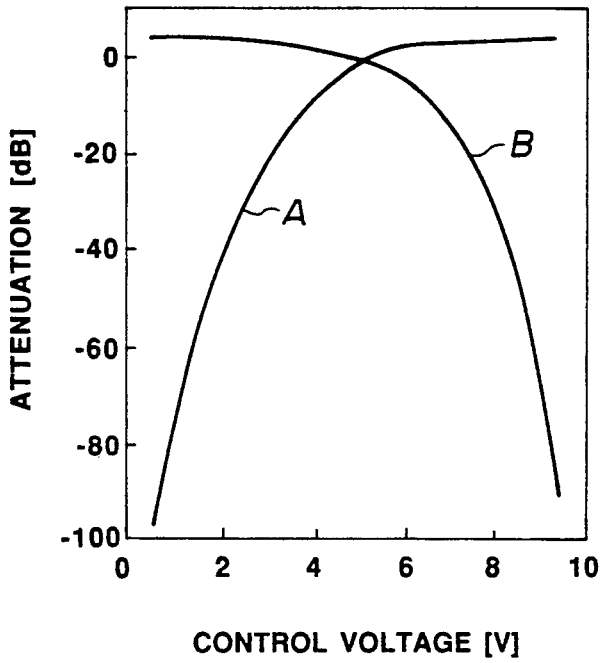
FIG. 2 is a characteristic diagram showing an example of an attenuation characteristic of the electronic volume control in FIG. 1.

In FIG. 1, input terminals of two channels 11L and 11R are supplied with, e.g., left and right channel signals of a stereo audio signal, or signals identical to each other in the case of a monaural audio signal. Respective input signals from these input terminals 11L and 11R are delivered to both a stereo surround processing circuit 13 and a monaural surround processing circuit 14 in a surround processing circuit block 12. Respective output signals of one channel (L-channel) of output signals of respective two channels from the stereo surround processing circuit 13 and the monaural surround processing circuit 14 are delivered to an electronic volume control 15L for L-channel, and respective output signals of the other channel (R-channel) are delivered to an electronic volume control 15R for R-channel. These electronic volume control 15L and 15R are of the same structure. The electronic volume 15L is provided with audio signal input terminals IN-A and IN-B of two channels of A and B, a control signal input terminal CTL, and audio signal output terminals OUT-A and OUT-B of two channels. The electronic volume control 15R is of a construction similar to that of the electronic volume control 15L. Here, the attenuations of the respective A and B channels versus a control voltage delivered to the control signal input terminal CTL of the electronic volume control 15L are as shown in FIG. 2, for example. This is also the case with 15R. In FIG. 2, curves A and B represent the attenuation characteristics of the A-channel and the B-channel, respectively. These curves represent the so called balance attenuation characteristic such that if the level of one curve increases, the level of the other curve decreases. Output signals from the output terminals OUT-A and OUT-B of A and B channels of the electronic volume control 15L (15R) having such a balance characteristic are added at a resistance adder 16L (16R), and the added signal is inverting-amplified at an inverting amplifier 17L (17R). Thus, a signal thus amplified is taken out as a left (right) channel output L-OUT (R-OUT) from an output terminal 18L (18R). Here, the electronic volume control 15L, the resistance adder 16L and the inverting amplifier 17L constitute a mixture ratio adjustable output circuit operative to add and mix the L-channel signal of the stereo surround processing output and the L-channel signal of the monaural surround processing output while varying the mixture ratio thereof to output it. Similarly, the electronic volume 15R, the resistance adder 16R and the inverting amplifier 17R constitute a mixture ratio adjustable output circuit with respect to the R-channel signal of the stereo surround processing output and the R-channel signal of the monaural surround processing output.

Further, respective input signals from the input terminals 11L and 11R of two channels are delivered to the stereo/monaural discrimination circuit 21. This stereo/monaural discrimination circuit 21 may be of various structures. In this embodiment, for this purpose, a L-R component detection subtracter 22, and a comparator 23 for comparing the level of this L-R component with a predetermined threshold level are provided in the stereo/monaural discrimination circuit 21. The subtracter 22 substracts a R-channel input signal supplied from the input terminal 11R from an L-channel input signal supplied from the input terminal 11L, thus to take out a L-R signal component. The reason why such a calculation is performed at the subtracter 22 is based on the fact that left and right signal components are exactly equal to each other at the time of monaural mode. An output from the subtracter 22 undergoes an absolute value processing or a peak hold processing according to need. The output thus processed is then delivered to a comparator 23, at which it is compared with a predetermined threshold value Vref. This threshold value Vref is obtained by dividing, e.g., a power supply voltage Vcc by resistance values of resistors $R_1$ and $R_2$. In the example shown in FIG. 1, the threshold value Vref is expressed as follows:

$$Vref = \frac{R_2}{R_1 + R_2} Vcc$$

An output from the comparator 23 serves as an output from the stereo/monaural discrimination circuit 21. When the level of the L-R component (the absolute value or the peak-hold value thereof) is below the threshold value Vref, an output from the stereo/monaural discrimination circuit 21 represents "L" (low level) to indicate that the input audio signal is a monaural signal, while when the level of the above-mentioned L-R component exceeds the threshold value Vref, that output represents "H" (high level) to indicate that the input audio signal is a stereo signal. However, even if the input audio signal is a stereo signal, in the case where a sound image is localized at the center, or the like, the above-mentioned L-R component substantially becomes equal to zero. As a result, if the stereo/monaural mode is switched to the monaural mode every time, a reproduced sound is extremely difficult to be heard. To improve this, an approach is employed to deliver an output from the stereo/monaural discrimination circuit 21 to a time constant circuit 25 to allow the output to have so called a time constant, thereby avoiding a sudden switching operation. This time constant circuit 25 is comprised of a reverse-current blocking diode $D_1$, a charge current limiting resistor $R_3$, a charge storage capacitor $C_1$, and a discharge current limiting resistor $R_4$. When it is discriminated at the stereo/monaural discrimination circuit 21 that an input signal is a stereo signal, so the discrimination output shifts to "H" (high level), a charge current flows in the capacitor $C_1$ through the diode $D_1$ and the resistor $R_3$. Finally, there results an equilibrium state at a voltage expressed below.

$$(Vcc - 0.6) \times \frac{R_4}{R_3 + R_4} \text{ V}$$

In the above equation, Vcc −0.6 V is a voltage when an output from the stereo/monaural discrimination circuit 21 is at "H" (high level). On the other hand, when it is discriminated that an input signal is a monaural signal, so the discrimination output shifts to "L" (low level), charges stored in the capacitor $C_1$ are discharged through the resistor $R_4$, so an output from the time constant circuit 25 finally reaches the above-mentioned low level (e.g., 0 V). Here, the charging resistor $R_3$ and the discharging resistor $R_4$ are both, e.g., 10 to 20KΩ and the capacitance value of the capacitor $C_1$ is set to, e.g., about 1000 μF wherein the charging operation and/or the discharging operation are carried out with a time constant of about several seconds. For this reason, even if, e.g., a signal such that the left and right levels are equal to each other appears in a stereo input signal, so an output from the stereo/monaural discrimination circuit 21 is switched from "H" to "L", an output from the time constant circuit 25 only gradually decreases. Namely, unless the same state is maintained for several seconds, there is no possibility that an output from the time constant circuit 25 completely shifts to that state. At this time, an output from the time constant circuit 25 is delivered, as a mixture ratio adjustable control signal, to each of the control signal input terminals CTL of the electronic volume controls 15L and 15R. Attenuations of respective electronic volume controls 15L and 15R vary on the basis of the balance characteristic as explained with reference to FIG. 2 in dependency upon an output voltage from the time constant circuit 25. Thus, switching of a signal in a form similar to an analog form including a transient intermediate level is carried out. Namely, since switching between a stereo surround processing signal and a monaural surround processing signal is gradually carried out including an intermediate state where those surround processing signals are mixed. Accordingly, there is no sense of incompatibility.

In the surround processor as described above, even if, e.g., an input signal is a stereo signal, in the case where a sound image is localized at the center, levels of left and right channels are equal to each other, so the discrimination output from the stereo/monaural discrimination circuit 21 may be switched from "H" to "L". When such a switching signal is passed through the time constant circuit 25, it changes to a signal of which level gradually lowers with a time constant of several seconds. By this signal slowly varying, attenuations of the respective electronic volume controls 15L and 15R of the mixture ratio adjustable output circuit are controlled. As a result, since respective electronic volume controls 15L and 15R have a balance characteristic as shown in FIG. 2 previously described, the mixture ratio between the stereo surround processing output signal and the monaural surround processing output signal gradually varies. In the case of the stereo input signal, since a difference between levels of left and right channels occurs for a second time, the discrimination output from the stereo/monaural discrimination circuit 21 returns from "L" to "H". Thus, the stereo surround processing output signal is selected. It is to be noted that if the duration of the state where the levels of the left and right channels are the same is sufficiently short, since the discrimination output state returns to the stereo discrimination state while the ratio of the monaural surround processing output signal mixed at the mixture ratio adjustable output circuit is extremely small, output signals nearly equal to those in the case where the stereo surround processing is maintained are provided from the output terminals 18L and 18R. In a manner as stated above, automatic switching between the stereo/monaural modes can be conducted without sense of incompatibility.

It is to be noted that this invention is not limited to the above-described embodiment. For example, while the discrimination between stereo/monaural modes is conducted by making use of L-R signal, an approach may be employed to compare a value of the ratio between L-R signal and L+R signal, etc. with a predetermined threshold value, or to carry out the above comparison in combination with a detected output of a stereo pilot signal in the case of a television broadcasting signal, thereby providing a discriminated result.

As is clear from the foregoing description, in accordance with the surround processor according to this invention, an approach is employed to mix an output signal from the stereo surround processing circuit and an output signal from the monaural surround processing circuit at a mixture ratio thereof suitably adjusted to output the mixed signal, and to carry out the discrimination between the stereo/monaural signals on the basis of an input signal to adjustably control the mixture ratio by the discrimination output caused to have a predetermined time constant. Thus, even if the stereo/monaural discrimination output is suddenly switched, it is caused to slowly change by the time constant. By such a signal slowly changing, the mixture ratio between the stereo surround processing output signal and the monaural surround processing output signal is adjustably controlled. Thus, a signal such that a stereo surround processed signal and a monaural surround processing signal are slowly switched is provided as an output signal. Accordingly, even if while, e.g., a stereo signal is inputted, there occurs the state partially approximate to a monaural signal, switching from the stereo surround processing output signal to the monaural surround processing output is slowly carried out. Thus, before switching to the stereo surround processing output signal, the stereo/monaural discrimination output returns to the stereo side, resulting in no adverse influence in the hearing sense. Further, in the case where an input signal is switched to a monaural signal, a monaural surround processing output signal is outputted slowly in several seconds, for example. Also in the case where switching from the monaural side to the stereo side is carried out, a stereo surround processing output signal is similarly slowly outputted. Thus, automatic switching between stereo/monaural modes can be realized without a sense of incompatibility. Accordingly the, user is not required to manually carry out a stereo/monaural switching operation in accordance with an input source. Thus, optimum surround processing output signals in conformity with respective signal forms (stereo/monaural) of the input source can be automatically provided.

What is claimed is:

1. A processor for an audio signal comprising;

a pair of input terminals supplied with two channel audio signals, a stereo processing circuit connected to said pair of input terminals for receiving the two channel audio signals and producing respective output signals, a monaural processing circuit connected to said pair of input terminals for receiving the two channel audio signals and producing respective output signals, a stereo/monaural detecting means receiving the two channel audio signals for detecting a level difference therebetween and producing therefrom a control signal, and variable ratio mixing means for mixing a signal from said stereo processing circuit and a signal from said monaural processing circuit in response to said control signal from said detecting means and producing respective output signals.

2. A processor for an audio signal as claimed in claim 1, wherein said stereo/monaural detecting means includes;

a time delay circuit for time delaying the control signal fed to said variable ratio mixing means.

3. A processor for an audio signal as claimed in claim 2 wherein said time delay circuit comprises a capacitor, a resistor, and a diode.

* * * * *